US005772088A

United States Patent [19]

Nelson

[11] Patent Number: 5,772,088

[45] Date of Patent: Jun. 30, 1998

[54] ADJUSTABLE INFANT CARRIER

[75] Inventor: Elizabeth Nelson, Walpole, Mass.

[73] Assignee: The First Years Inc., Avon, Mass.

[21] Appl. No.: 556,039

[22] Filed: Nov. 9, 1995

[51] Int. Cl.[6] ..... A61G 1/00

[52] U.S. Cl. ..... 224/160; 224/158; 224/159

[58] Field of Search ..... 224/157–161

[56] References Cited

U.S. PATENT DOCUMENTS

| | | | |
|---|---|---|---|
| D. 267,284 | 12/1982 | Andrews | D2/33 |
| 2,537,864 | 1/1951 | Skaer | 224/160 |
| 4,434,920 | 3/1984 | Moore | 224/160 |
| 4,923,104 | 5/1990 | Rice et al. | 224/160 |
| 4,982,997 | 1/1991 | Knoedler et al. | 297/296 |
| 5,178,309 | 1/1993 | Bicheler et al. | 224/153 |
| 5,246,152 | 9/1993 | Dotseth | 224/158 |
| 5,333,769 | 8/1994 | Skroski | 224/158 |
| 5,361,952 | 11/1994 | Gold | 224/159 |
| 5,490,620 | 2/1996 | Bergqvist | 224/160 |

FOREIGN PATENT DOCUMENTS

| | | | |
|---|---|---|---|
| 2404414 | 4/1979 | France | 224/160 |

OTHER PUBLICATIONS

Snugli® Legacy infant carrier, Model No. 018; Gerry Baby Products, Denver, CO.

"It's Time for Gerry Baby Products", product literature, Gerry Baby Products, Denver, CO.

Instructions for Snugli® Legacy, Gerry Baby Products, Denver, CO.

*Primary Examiner*—Henry J. Recla
*Assistant Examiner*—Timothy L. Maust
*Attorney, Agent, or Firm*—Fish & Richardson P.C.

[57] ABSTRACT

An infant carrier including a sack of flexible sheet material dimensioned to receive an infant, an elongate crotch portion extending from the lower front portion of the sack to the rear of the sack and positioned to be placed between the infant's legs to support the infant during carrying, and, positioned on the crotch portion, an adjustment device that is movable between a plurality of positions to vary the length of the elongate crotch portion.

25 Claims, 9 Drawing Sheets

ADJUSTABLE INFANT CARRIER

BACKGROUND OF THE INVENTION

The present invention relates to infant carriers.

Infant carriers are available which allow an adult to easily carry an infant, while walking or standing. These carriers typically comprise a pouch having openings through which the infant's legs protrude, provided with straps that can be worn over the adult's shoulders.

SUMMARY OF THE INVENTION

The present invention provides an improved infant carrier.

The infant carrier includes a sack dimensioned to receive and surround an infant so that the legs of the infant are within the sack, and having an elongate crotch portion extending from the lower front portion of the sack to the rear of the sack and positioned to be placed between the infant's legs to support the infant during carrying, and, mounted on the sack, a pair of straps dimensioned to extend over the shoulders of an adult to allow the sack to be carried.

In preferred embodiments, the sack is insulated; the straps extend over the adult's shoulders and cross across the adult's back; the straps are removably fastened to the sack; the length of the straps is adjustable; the portion of the sack surrounding the infant's legs is substantially square when viewed from the front; the portion of the sack surrounding the infant's legs includes a divider separating the infant's legs; and the divider comprises an aperture extending through the sack and being sealed around its perimeter to prevent access to the bag through the aperture, the aperture being sized to receive a car-seat belt therethrough.

Preferably, the size of the infant carrier is adjustable to provide support and a comfortable secure fit over a range of infant sizes. This adjustability also allows the carrier to accommodate the growth of an infant or the different thicknesses of clothes worn by an infant on different days.

To provide this adjustability, the infant carrier further includes, positioned on the crotch portion, an adjustment device that is movable between a plurality of positions to vary the length of the elongate crotch portion. In this embodiment, the crotch portion is preferably independent of the sack, i.e., is formed of a separate length of material the ends of which are stitched or otherwise fastened at the inner surface of the sack through the material of the sack.

In a preferred embodiment, the adjustment device includes an adjustable strap extending longitudinally along said elongate crotch portion and having two opposite ends secured to two longitudinally spaced regions of said crotch portion, and a fastener that is capable of adjusting the distance between the two spaced regions. Preferably, the adjustment device comprises a pair of such straps, spaced apart widthwise across the crotch portion. Preferred adjustable straps comprise a buckle, a first strap portion and a second strap portion. The first strap portion is threaded through a first portion of the buckle and a first end of the first strap portion is secured to a first region of the crotch portion and the second end is doubled back and secured to either the first strap portion or the first region of the crotch portion. The second strap portion is threaded through a second portion of the buckle and a first end of the second strap portion is secured to a second region of the crotch portion, longitudinally spaced from the first region, while a second end of the second strap portion is free. This arrangement allows the length of the crotch portion to be easily shortened by sliding the buckle along the length of the second strap portion towards the first, mounted end, or lengthened by sliding the buckle towards the second, free end of the second strap portion.

In another aspect, the invention features an infant carrier including a pocket in a region of the carrier which, in use, will be adjacent the back of the infant, a support member comprising a rigid or semi-rigid sheet disposed in the pocket to support the back of the infant during carrying, and a waist cinch strap mounted horizontally on the carrier in a region which, in use, will be adjacent the midsection of the infant, the length of the waist cinch strap being adjustable to position the infant's back adjacent the support member.

In preferred embodiments, the carrier, in addition to the shoulder straps, includes a crotch adjustment device, a pocket containing a support member and a waist cinch strap. This arrangement provides, in addition to adjustability, comfort and support for the infant.

Other features and advantages of the invention will be apparent from the description of preferred embodiments thereof, taken together with the drawings, and from the claims.

BRIEF DESCRIPTION OF THE DRAWINGS

In FIG. 4, the adjustment device is adjusted so that the crotch portion of the infant carrier is relatively long; in FIG. 5 the adjustment device is tightened so that the crotch portion is relatively short.

DESCRIPTION OF THE PREFERRED EMBODIMENTS

Figure 1:
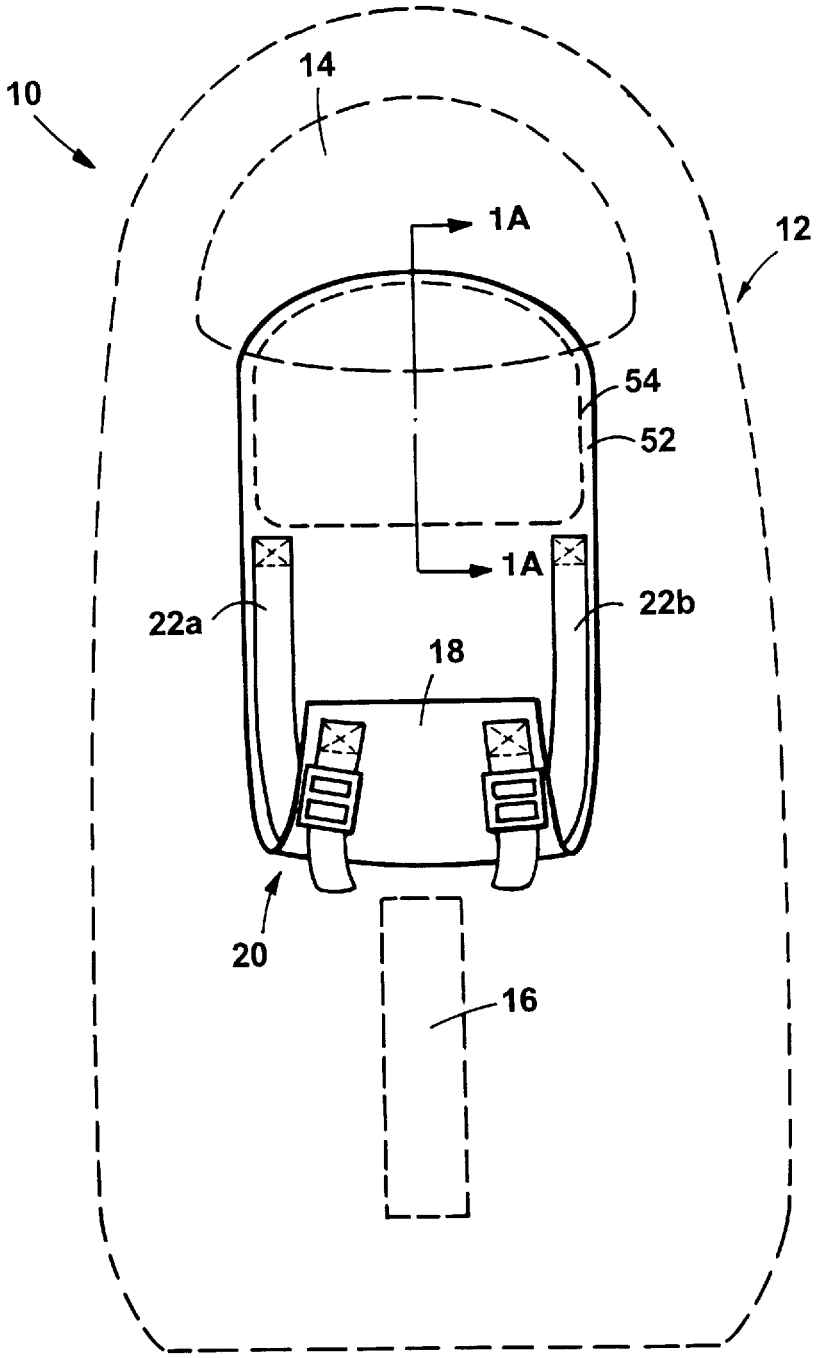
FIG. 1 is a diagrammatic front plan view of an infant carrier (broken lines) including a crotch portion and an adjustment device (solid lines) according to one embodiment of the invention.

Referring to FIG. 1, infant carrier 10 includes a garment or sack 12 having a top opening 14 for the infant's head. The garment or sack 12 may be formed of any desired material, e.g., woven or non-woven cloth or fabric or flexible plastic sheet material, as is well known in the infant carrier field. A particularly preferred material is an insulative material, e.g., a quilted fabric including a shell, a lining and an insulated layer interposed between the shell and lining. The garment or sack 12 may include a fastenable front opening, e.g., an opening provided with a zipper, as shown in FIG. 2, buttons or other fastener(s), to facilitate putting the infant into and removing the infant from the carrier, or the top opening 14 may be made sufficiently large to receive the infant.

The garment or sack 12 also includes a divider 16 that divides the lower portion of the carrier into two compartments for the infant's legs. This divider may take the form of an opening, stitched around its perimeter to seal the edges of the front and back of the sack so that the inside of the sack cannot be accessed through the aperture. In this case, the aperture is preferably dimensioned so that the restraint device of an infant car-seat carrier can be inserted through the aperture so that the infant can be easily buckled into a car-seat without removing the infant from the carrier.

Figure 2:
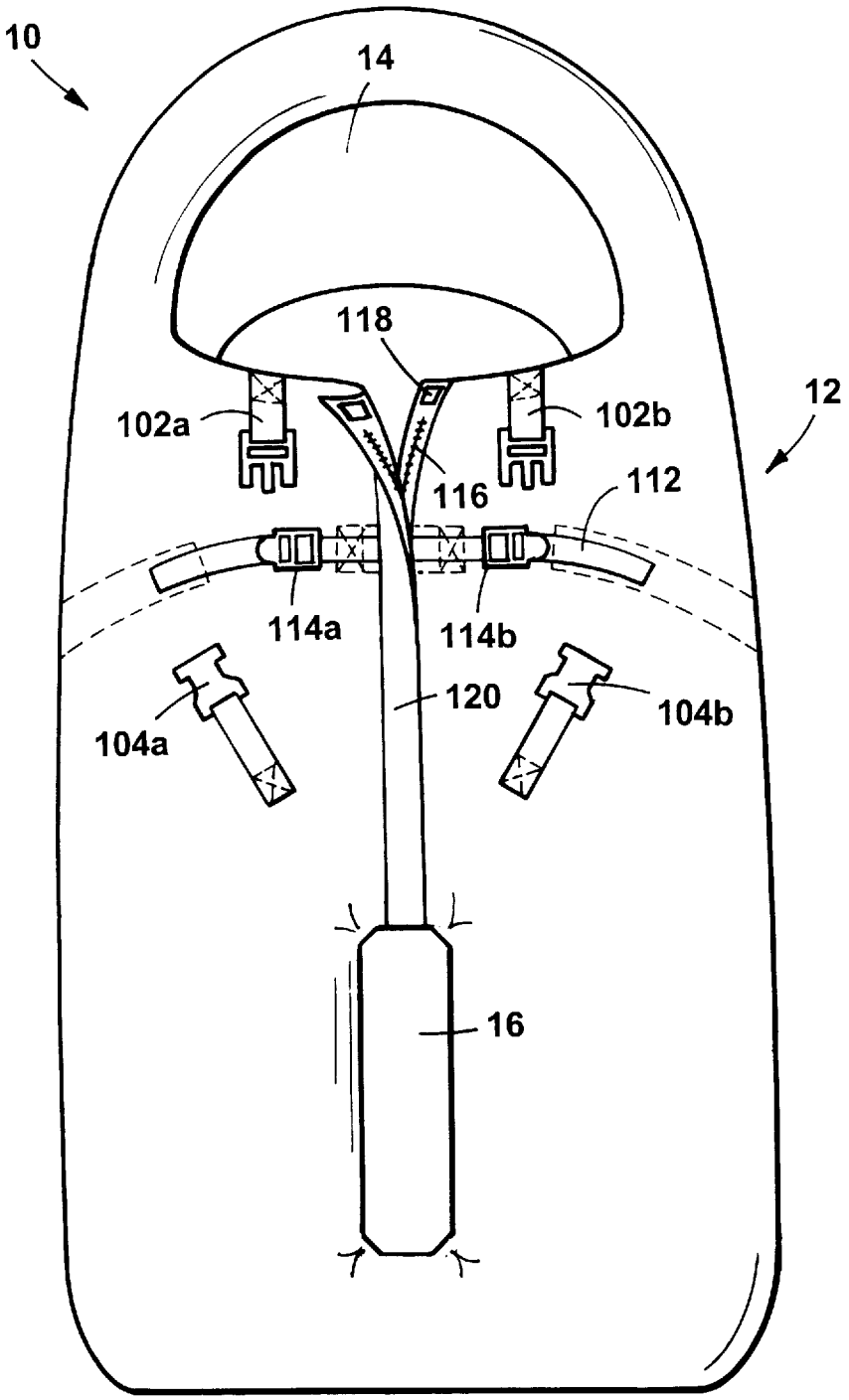
FIG. 2 is a diagrammatic front plan view of the an infant carrier of FIG. 1, with the exterior features shown in solid lines.
Figure 2A:
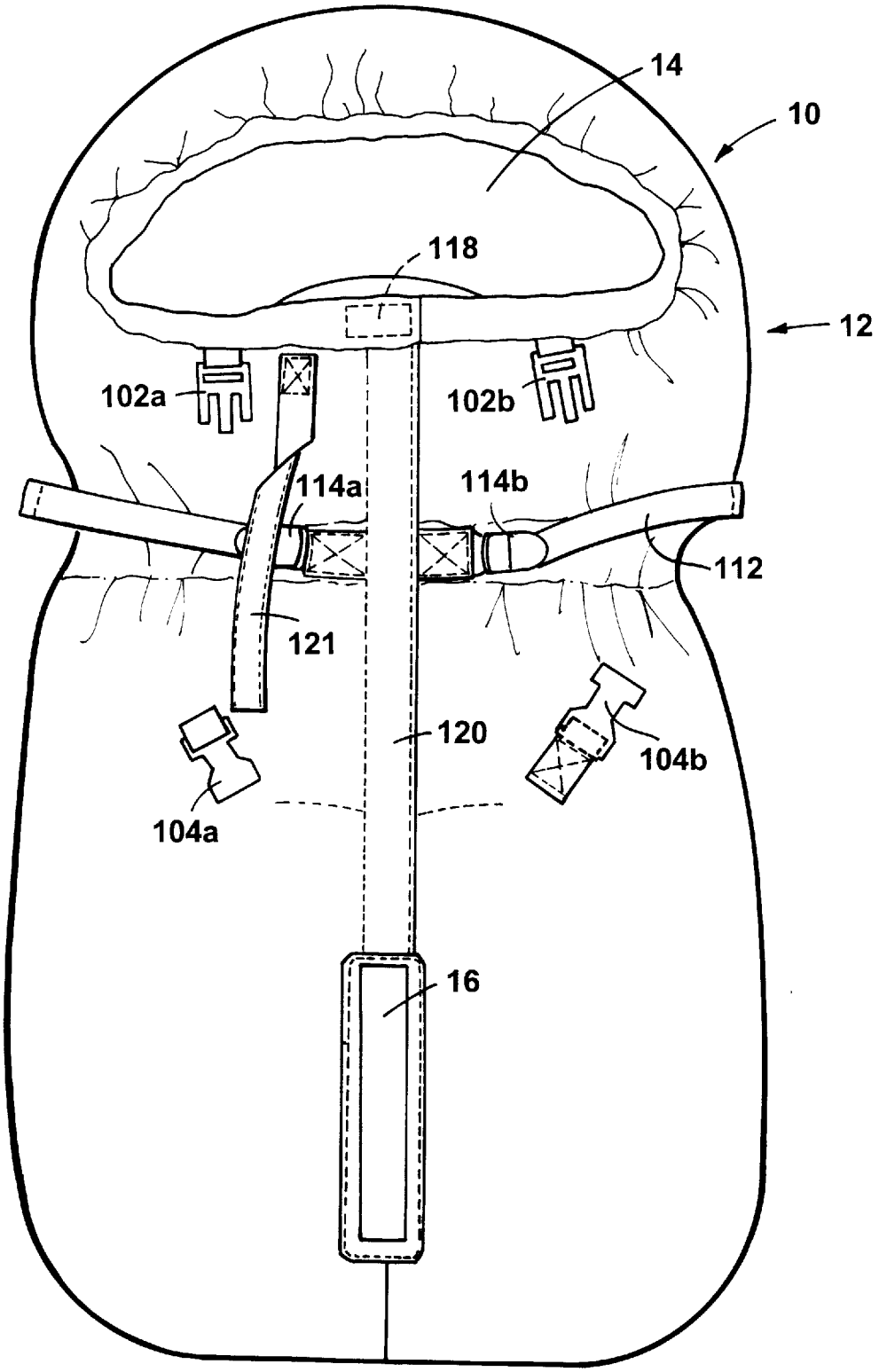
FIG. 2*a* is a front plan view of the carrier of FIGS. 1 and 2, shown with the waist cinch strap shortened.
Figure 2B:
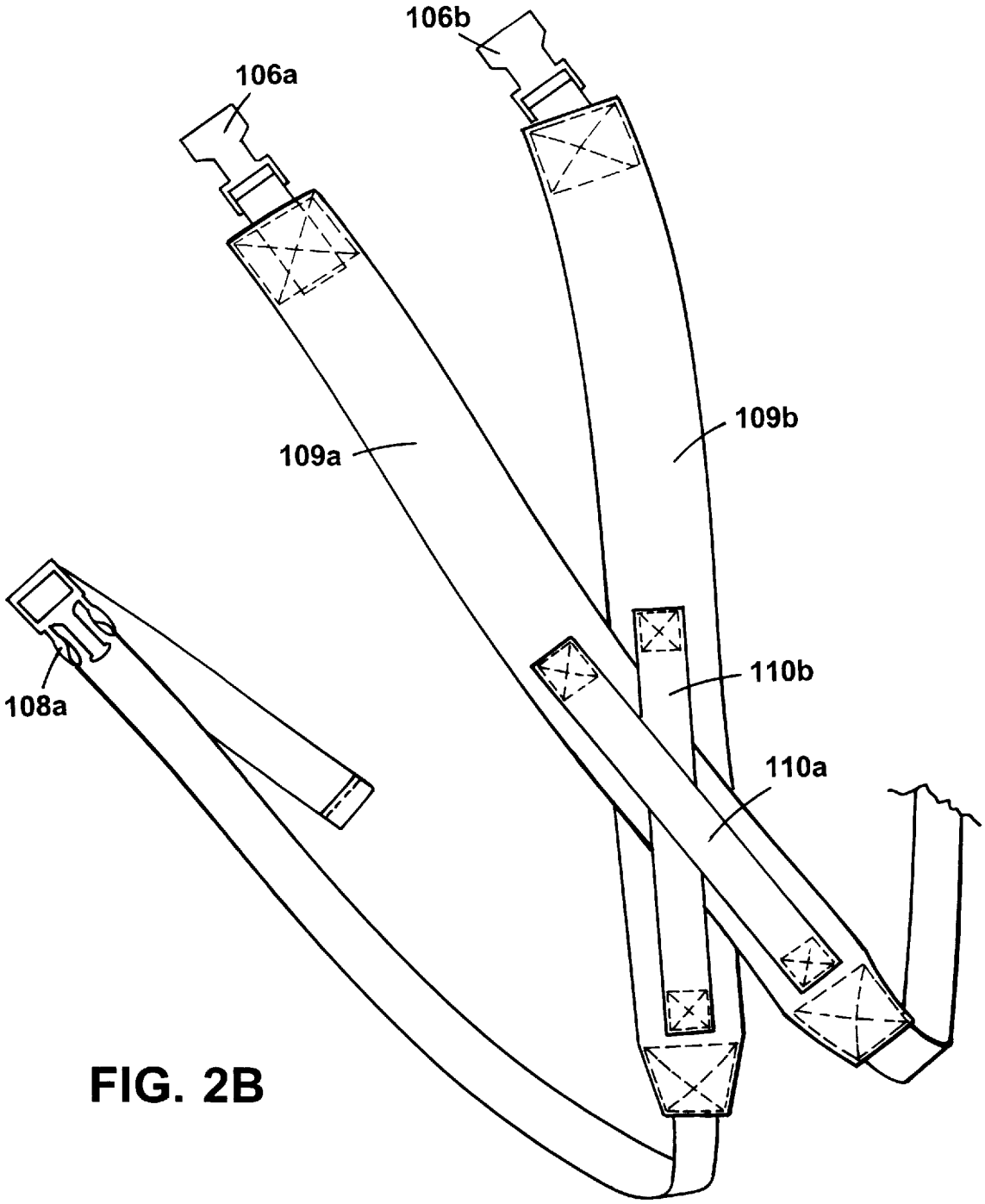
FIG. 2*b* is a schematic perspective view of straps for use with the carrier of FIGS. 1 and 2.
Figure 3:
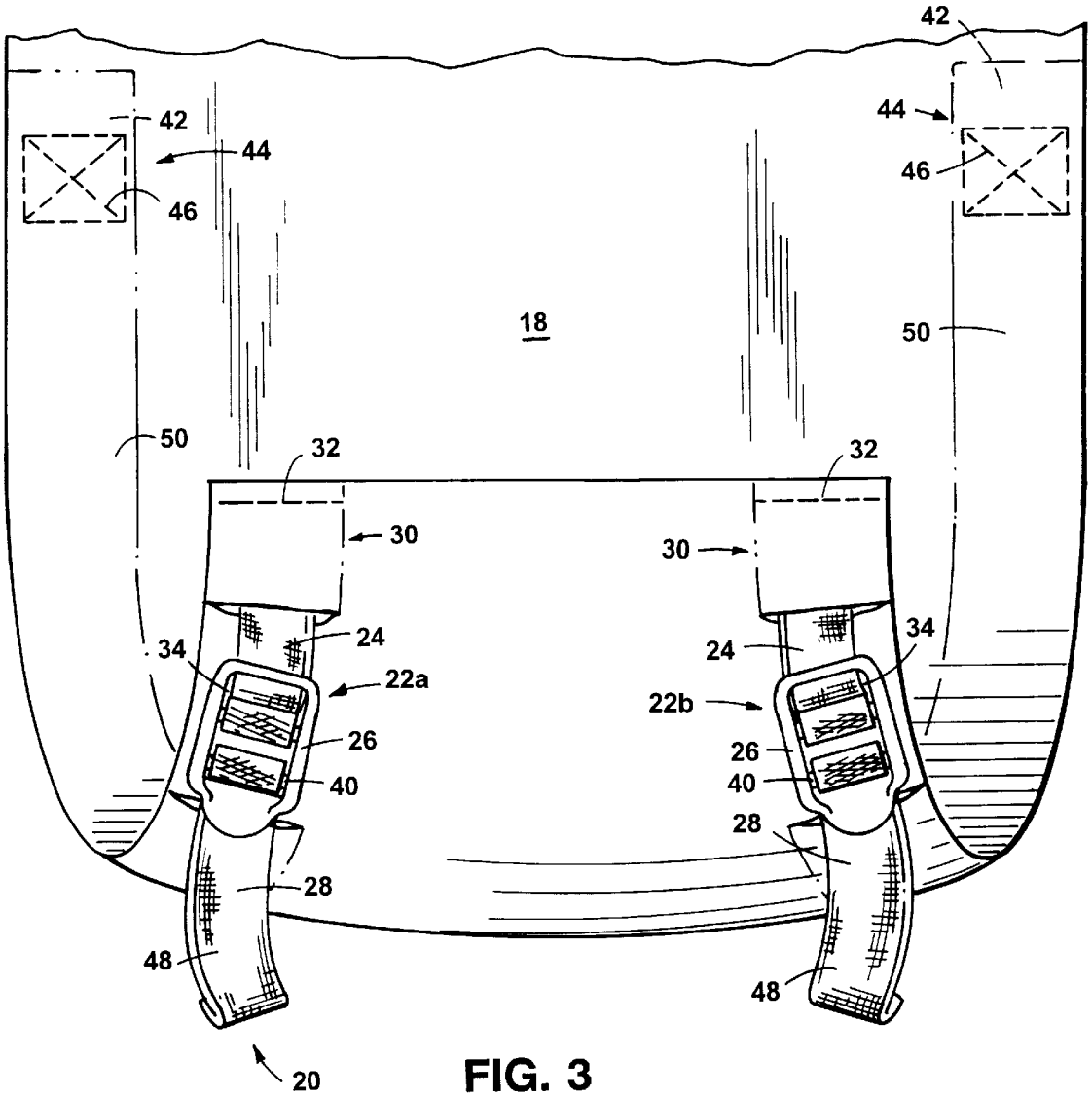
FIG. 3 is an enlarged detailed front view of the adjustment device shown in FIG. 1.

Referring to FIGS. 2 and 2*a*, the exterior of the carrier includes top male buckles 102*a*, 102*b* and bottom female buckles 104*a*, 104*b*, positioned to receive the corresponding female buckles 106*a*, 106*b* and male buckles 108*a* and the right-hand male buckle (not shown), respectively, of the shoulder straps 109*a*, 109*b*, shown in FIG. 2*b*. As shown in FIG. 2*b*, the straps preferably are crossed, and are retained in their crossed position by cross straps 110*a*, 110*b*. Preferably, the shoulder straps include a foam padding layer, as is well known in the backpack art, to improve comfort during use of the carrier.

The exterior of the carrier further includes an adjustable waist cinch strap 112, shown in a lengthened position in FIG. 2 and in a shortened, "snugged" position in FIG. 2*a*. This strap is positioned near the infant's midsection, and can be adjusted to hold the infant securely but comfortably in place with the infant's back against the support member. Preferably, as shown, the cinch strap is adjustable by a pair of buckles 114*a*, 114*b*, one on either side of the front of the carrier.

Preferably, the buckles of both the shoulder straps and the waist cinch strap are positioned to be within easy reach of the adult during use of the carrier, so that adjustments can be fine-tuned without removing the carrier.

The infant carrier preferably also includes, as shown, a front fastener 116 (FIG. 2), e.g., a zipper, having a securing fastener 118, e.g., a hook and loop fastener or snap, near the top of the front fastener. The front fastener 116 is preferably covered by a flap 120.

Additionally, the carrier may include a pacifier tether 121 (FIG. 2*a*), comprising a strap having a loop or other fastener at its end to receive a pacifier, so that the pacifier is readily available.

Figure 4:
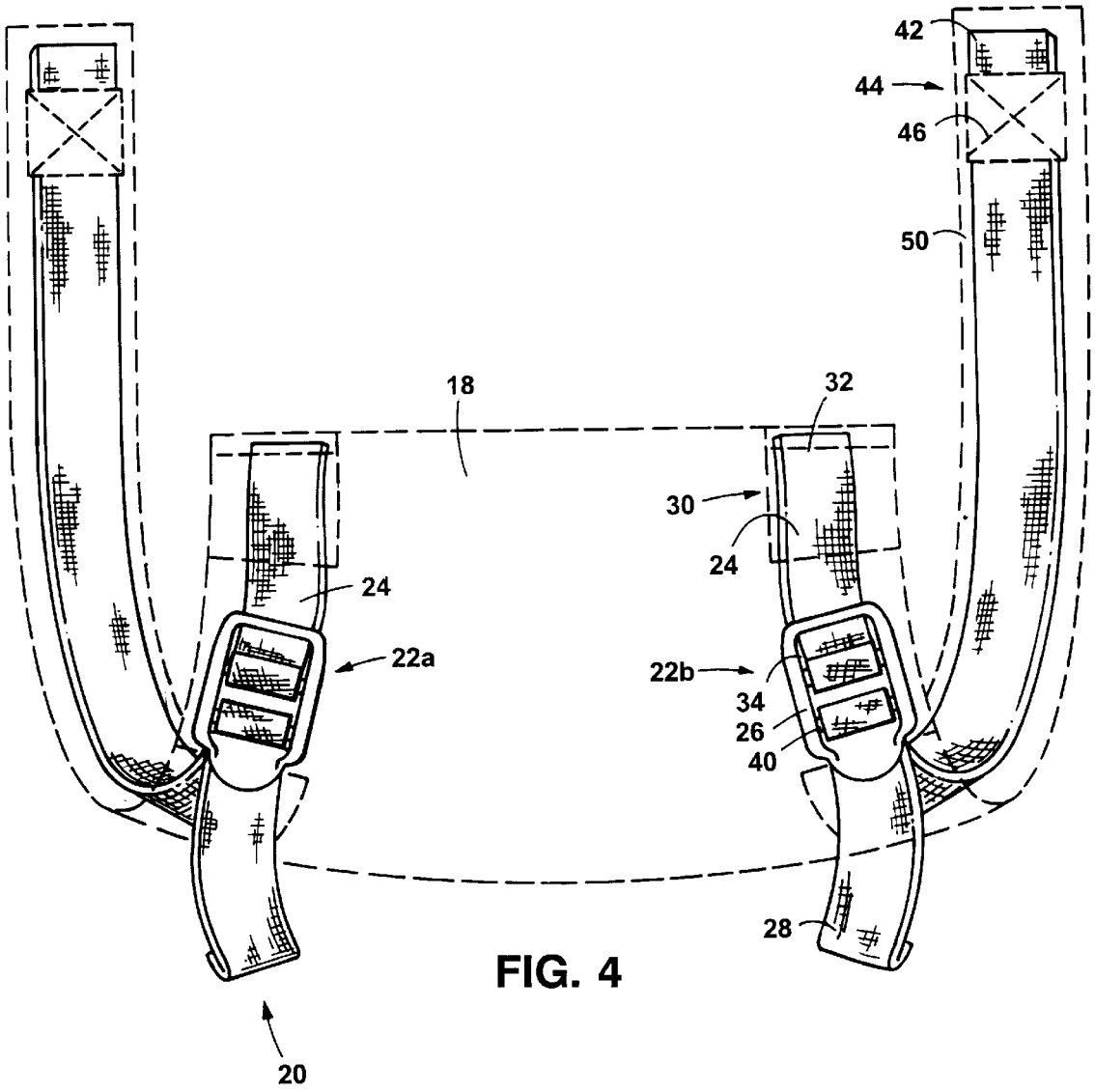
FIGS. 4 and 5 are enlarged detailed front views of the adjustment device shown in FIG. 1, in which the infant carrier is shown in broken lines so that the entire adjustment device is visible.
Figure 5:
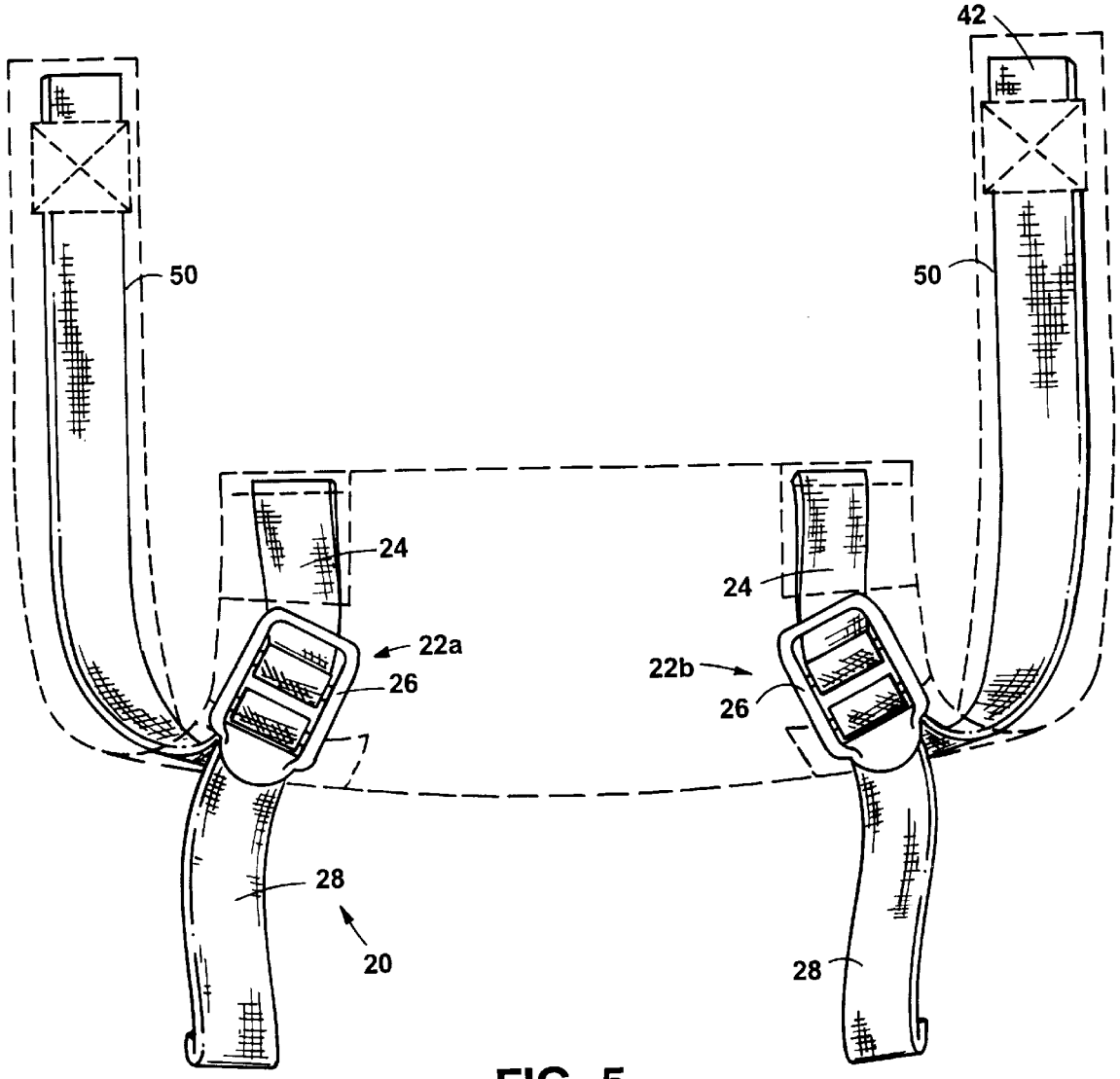
Figure 6:
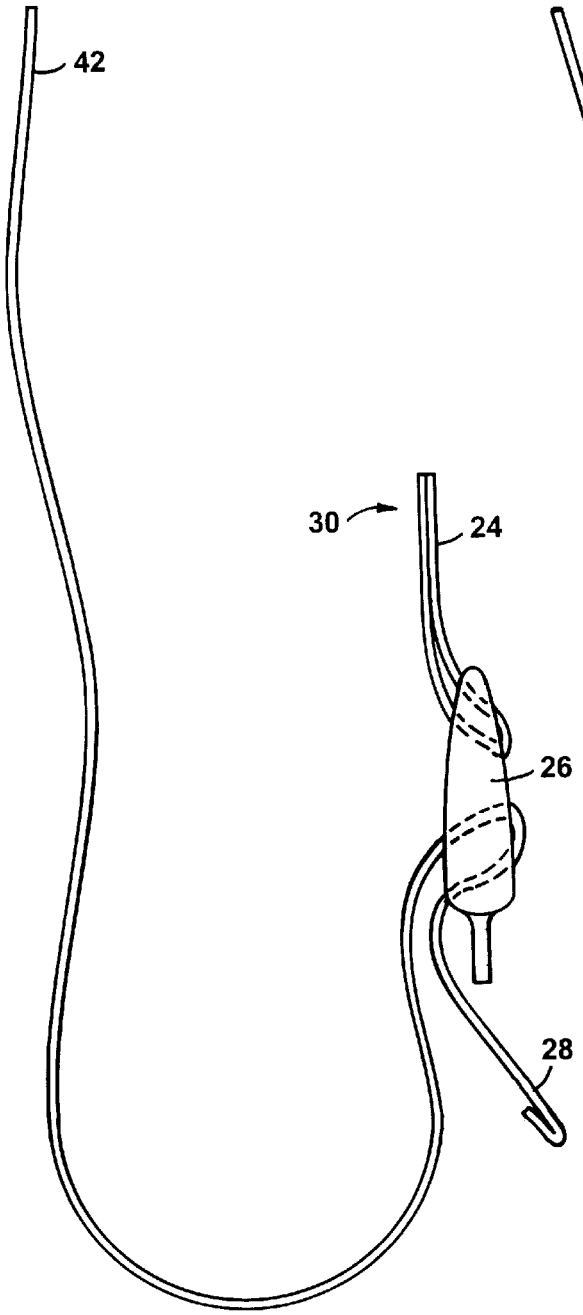
FIGS. 6 and 7 are somewhat diagrammatic side views of the crotch portion of the infant carrier of FIG. 1 in the positions shown in FIGS. 4 and 5, respectively.
Figure 7:
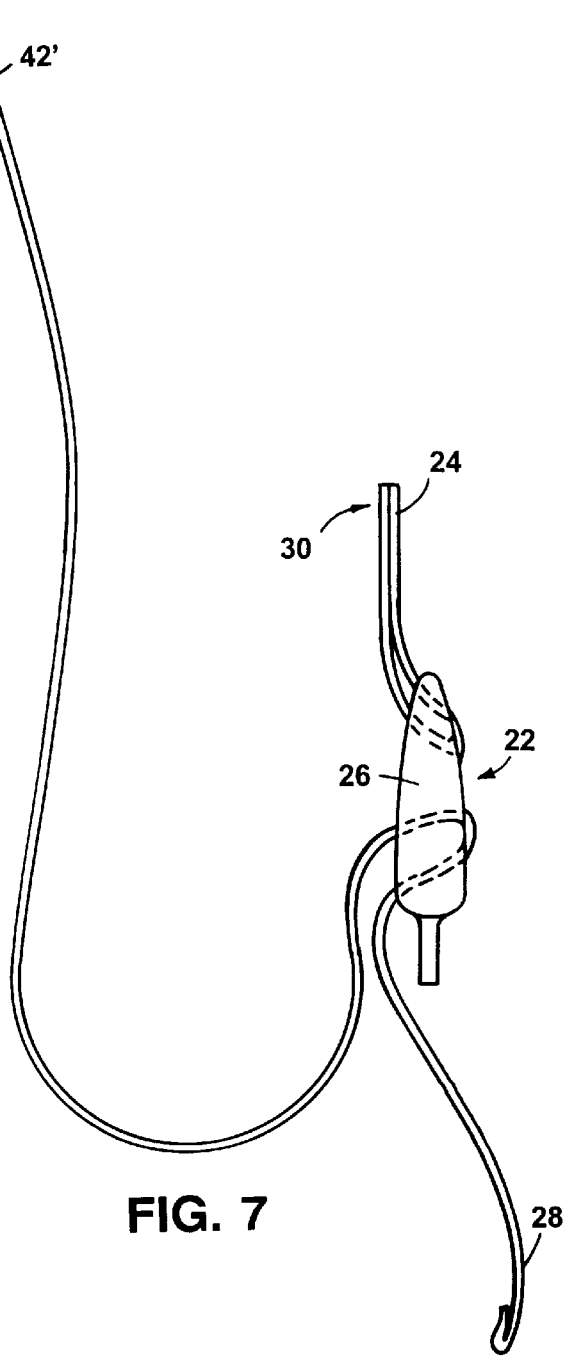

According to the invention, the infant carrier further includes an elongate crotch portion 18 and adjustment device 20, mounted on the crotch portion (FIG. 1 and FIGS. 3–5). The crotch portion is independent of the sack, i.e., it comprises a separate length of material stitched to the sack. The crotch portion is stitched securely through all layers of the front portion of the sack at one of its ends, and all layers of the rear portion of the sack at its other end. Adjustment device 20 includes a pair of adjustment straps 22*a*, 22*b*. As shown in detail in FIGS. 3–5, each adjustment strap includes a first portion 24, a buckle 26, and a second portion 28. First portion 24 is threaded through a first portion 34 of buckle 26. The first portion 24 is then doubled over around the threaded buckle and both ends are secured to the crotch portion by stitching 32. Second portion 28 is threaded through second portion 40 of buckle 26. As shown in FIG. 4, a first end 42 of second portion 28 is secured to a second region 44 of crotch portion 18, spaced longitudinally from the first region 30, e.g., by stitching 46 as shown, and free end 48 extends freely from the buckle. In this manner, as shown in FIGS. 4–7, by pulling the second portion 28 through the buckle, lengthening the distance between the buckle and the free end 48, the crotch portion can be made shorter (FIGS. 5 and 7), while by moving the buckle in the opposite direction, shortening the distance between the buckle and free end 48, the crotch portion can be made longer (FIGS. 4 and 6). In order to facilitate adjustment of the crotch in this manner, the part of second portion 28 that extends between first end 42 and buckle 26 is contained in a channel 50, so that it gathers the material of the crotch portion when shortened (as shown schematically in FIG. 5), rather than gapping away from the crotch portion.

In a preferred embodiment, the divider 16 is positioned so that it will provide additional support to the crotch portion when the crotch portion is in its most extended position (and thus is typically supporting the heaviest infant). It is noted, however, that one advantage to the carrier of the invention is that even if both the crotch portion and divider were to fail, the infant would not fall from the carrier, but would instead be safely retained by the bottom of the sack.

Figure 1A:
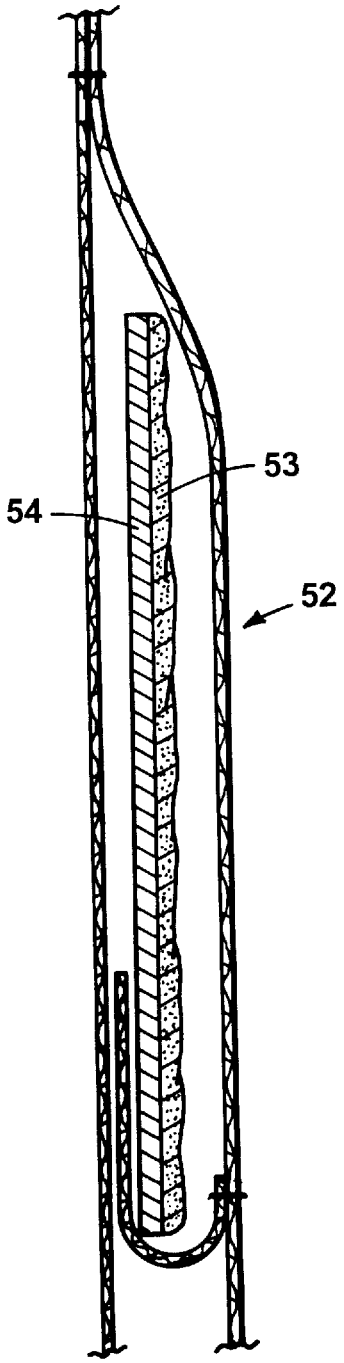
FIG. 1*a* is an enlarged partial cross-sectional view, taken along line 1A—1A, of a portion of the infant carrier of FIG. 1.

As shown in FIGS. 1 and 1*a*, the infant carrier 10 preferably further includes a pocket 52 and a support member 54 disposed within pocket 52. The pocket is positioned on the portion of the garment or sack 12 that will be adjacent the back of the infant when the infant carrier is in use. Support member 54 comprises a sheet of relatively thin, rigid or semi-rigid sheet material. Preferred materials include polypropylene. The sheet material may be backed with a foam layer 53 to provide a cushioning effect in addition to the support provided by support member 54. The pocket may be openable by the user of the infant carrier, to allow the support member to be removed and replaced, or may be stitched closed.

Other embodiments are within the claims. For example, although the adjustment device illustrated above is a strap and buckle arrangement, many other types of adjustment devices could be used, e.g., straps with hook and loop fastener portions, straps including a series of snaps or other discrete fasteners, or similar fastener arrangements positioned directly on spaced regions of the crotch portion in a manner to shorten the crotch portion when fastened, e.g., the fasteners are mounted on the crotch portion and spaced apart in series such that the length of the crotch portion can be adjusted by fastening a selected pair of said fasteners. Also, while various possible types of infant carriers have been discussed above, the invention may be used with many other types of infant carriers, as would be understood by one skilled in the art.

What is claimed is:

1. An infant carrier comprising a sack of flexible material dimensioned to receive and surround an infant so that the legs of the infant are within the sack, the sack having a lower front portion and a rear portion;

a divider, positioned at the portion of the sack surrounding the infant's legs to define a compartment for each of the infant's legs;

an elongate crotch portion extending from the lower front portion of the sack to the rear of the sack and positioned to be placed between the infant's legs to support the infant during carrying;

an adjustment device, positioned on said crotch portion, movable between a plurality of positions to vary the length of said elongate crotch portion, said adjustment device comprising an adjustable strap extending longitudinally along said elongate crotch portion and having two opposite ends secured to two longitudinally spaced regions of said crotch portion, and a fastener capable of adjusting the distance between the two spaced regions; and a pair of shoulder straps mounted on the sack, said straps being dimensioned to extend over the shoulders of an adult to allow the sack to be carried.

2. The infant carrier of claim 1 wherein said shoulder straps are mounted on a region of the sack which would be adjacent the front of the infant during use.

3. The infant carrier of claim 1 wherein said sack comprises insulative material.

4. The infant carrier of claim 1 wherein the ends of said shoulder straps are positioned on the sack so that the straps are crossed.

5. The infant carrier of claim 1 wherein said shoulder straps are removably mounted on the sack.

6. The infant carrier of claim 1 wherein the length of said shoulder straps is adjustable.

7. The infant carrier of claim 6 wherein said shoulder straps include an adjustment device that is positioned to be within reach of an adult carrying the carrier.

8. The infant carrier of claim 1 wherein the portion of the sack surrounding the infant's legs is substantially square when viewed from the front.

9. The infant carrier of claim 1 wherein the divider comprises an aperture extending through the sack and being sealed around its perimeter to prevent access to the bag through the aperture, the aperture being sized to receive an infant car-seat restraint device therethrough.

10. The infant carrier of claim 1 wherein a region of said adjustable strap of said adjustment device is contained within a channel in said sack.

11. The infant carrier of claim 1 wherein said adjustment device comprises a pair of said adjustable straps, mounted in widthwise spaced relation on said crotch portion.

12. The infant carrier of claim 1 wherein said fastener is a buckle.

13. The infant carrier of claim 1 wherein said adjustment device comprises a buckle and said adjustable strap of said adjustment device comprises a first strap portion and a second strap portion, wherein said first strap portion is threaded through a first portion of said buckle and a first end of said first strap portion is secured to a first region of said crotch portion, and the second end is secured to the first region of the crotch portion and said second strap portion is threaded through a second portion of said buckle and a first end of said second strap portion is secured to a second region of said crotch portion, longitudinally spaced from said first region, while a second end of said second strap portion is free, so that the length of said crotch portion can be easily shortened by sliding said buckle along the length of said second strap portion towards said first end, or lengthened by sliding said buckle towards said second end of said second strap portion.

14. The infant carrier of claim 13 wherein said region of said second strap portion extending between said first end and said buckle is contained within an elongated channel mounted on said sack.

15. The infant carrier of claim 1 further comprising a pocket in a region of the carrier which, in use, will be adjacent the back of the infant; and a support member comprising a rigid or semi-rigid sheet disposed in said pocket to support the back of the infant during carrying.

16. The infant carrier of claim 15 further comprising a waist cinch strap mounted horizontally on the carrier in a region which, in use, will be adjacent the midsection of the infant, the length of the waist cinch strap being adjustable to position the infant's back adjacent the support member.

17. The infant carrier of claim 16 wherein said waist cinch strap includes an adjustment device that is positioned to be within reach of an adult carrying the carrier.

18. The infant carrier of claim 1 wherein said crotch portion is independent from said sack.

19. The infant carrier of claim 1 wherein the crotch portion is stitched securely through the material of the front portion of the sack at one of its ends, and through the material of the rear portion of the sack at its other end.

20. The infant carrier of claim 1 wherein said shoulder straps include a foam layer.

21. The infant carrier of claim 1 further comprising a tether including a fastener dimensioned to receive a pacifier.

22. The infant carrier of claim 1 wherein said crotch portion is adjustable between a first, lengthened position and a second, shortened position, and said divider is positioned to support said crotch portion when it is in said lengthened position.

23. An infant carrier comprising a sack of flexible material dimensioned to receive and surround an infant so that the legs of the infant are within the sack, the sack having a lower front portion and a rear portion;

a pocket in the region of the carrier which, in use, will be adjacent the back of the infant;

a support member comprising a rigid or semi-rigid sheet disposed in said pocket to support the back of the infant during carrying;

a waist cinch strap mounted horizontally on the carrier in a region which, in use, will be adjacent the midsection of the infant, the length of the waist cinch strap being adjustable to position the infant's back against said support member;

an elongate crotch portion extending from the lower front portion of the sack to the rear of the sack and positioned to be placed between the infant's legs to support the infant during carrying; and a pair of straps mounted on the sack, said straps being dimensioned to extend over the shoulders of an adult to allow the sack to be carried.

24. The infant carrier of claim 23 wherein said waist cinch strap includes an adjustment device that is positioned to be within reach of an adult carrying the carrier.

25. The infant carrier of claim 23 further comprising an adjustment device, positioned on said crotch portion, that is movable between a plurality of positions to vary the length of said elongate crotch portion.

* * * * *